US011691263B2

(12) United States Patent
Liau

(10) Patent No.: US 11,691,263 B2
(45) Date of Patent: Jul. 4, 2023

(54) WRENCH STRUCTURE

(71) Applicant: Jia-Guann Liau, Taichung (TW)

(72) Inventor: Jia-Guann Liau, Taichung (TW)

( * ) Notice: Subject to any disclaimer, the term of this patent is extended or adjusted under 35 U.S.C. 154(b) by 68 days.

(21) Appl. No.: 17/381,381

(22) Filed: Jul. 21, 2021

(65) Prior Publication Data

US 2023/0022175 A1 Jan. 26, 2023

(51) Int. Cl.
*B25G 1/10* (2006.01)
*B25B 13/46* (2006.01)

(52) U.S. Cl.
CPC ..... *B25G 1/102* (2013.01); *B25B 13/462* (2013.01)

(58) Field of Classification Search
CPC ..... B25G 1/102; B25B 13/462; B25B 23/16
USPC ..... 81/177.1, 60
See application file for complete search history.

(56) References Cited

U.S. PATENT DOCUMENTS

2012/0174716 A1* 7/2012 Tsai ..... B25B 13/461 81/60

FOREIGN PATENT DOCUMENTS

TW I579114 B 4/2017

* cited by examiner

*Primary Examiner* — Don M Anderson
*Assistant Examiner* — Caleb Andrew Holizna
(74) *Attorney, Agent, or Firm* — Alan D. Kamrath; Karin L. Williams; Mayer & Williams PC

(57) ABSTRACT

A wrench structure includes a main body provided with a drive portion, a shank, a protruding block, a handle, a first connecting portion, and a second connecting portion. The shank has two first faces and two second faces formed on two sides thereof. The protruding block has two third faces and two fourth faces. The handle has two fifth faces and two sixth faces. The first connecting portion has two seventh faces and two eighth faces. Thus, the main body is sequentially provided with the drive portion, the shank, the second connecting portion, the protruding block, the first connecting portion, and the handle. The shank, the protruding block, the first connecting portion, and the handle have different height and width defined therebetween.

12 Claims, 10 Drawing Sheets

WRENCH STRUCTURE

BACKGROUND OF THE INVENTION

1. Field of the Invention

The present invention relates to a hand tool and, more particularly, to a wrench structure.

2. Description of the Related Art

A conventional wrench structure was disclosed in the applicant's Taiwanese Patent Publication No. 1579114, and comprises a main body 10 provided a shank 11. The shank 11 has a top and a bottom each provided with a concave portion 112. The shank 11 is provided with a protruding block 113. The shank 11 has a first end provided with a first rotary portion 12 and a second end provided with a second rotary portion 13. However, when the conventional wrench structure is placed on a plane, such as a table, the distance defined between the plane and the shank 11, the protruding block 113, the first rotary portion 12, and the second rotary portion 13 is limited so that the user cannot take up the conventional wrench structure easily and conveniently.

BRIEF SUMMARY OF THE INVENTION

In accordance with the present invention, there is provided a wrench structure comprising a main body provided with a drive portion, a shank, a protruding block, a handle, a first connecting portion, and a second connecting portion. The shank has two first faces and two second faces formed on two sides thereof. The protruding block has two third faces and two fourth faces. The handle has two fifth faces and two sixth faces. The first connecting portion has two seventh faces and two eighth faces. Thus, the main body is sequentially provided with the drive portion, the shank, the second connecting portion, the protruding block, the first connecting portion, and the handle. The shank, the protruding block, the first connecting portion, and the handle have different height and width defined therebetween.

According to the primary advantage of the present invention, the shank, the protruding block, the first connecting portion, and the handle have different height and width defined therebetween. The protruding block has the maximum height and width. Thus, when the main body is placed on a plane, the protruding block and the handle rest on the plane, while a gap is defined between the shank and the plane and defined between the first connecting portion and the plane, so that the use takes the wrench structure easily through the shank and the first connecting portion. When the user holds the handle, the user's finger may rest on the first connecting portion according to the requirement. Each of the two seventh faces has a concave arcuate shape, and each of the two eighth faces has a concave arcuate shape, to facilitate the user rotating the wrench structure. When the user holds the main body, the user's finger may rest on the protruding block to operate the wrench structure exactly. When the user takes the wrench structure, the user's palm directly holds the protruding block to operate the wrench structure conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
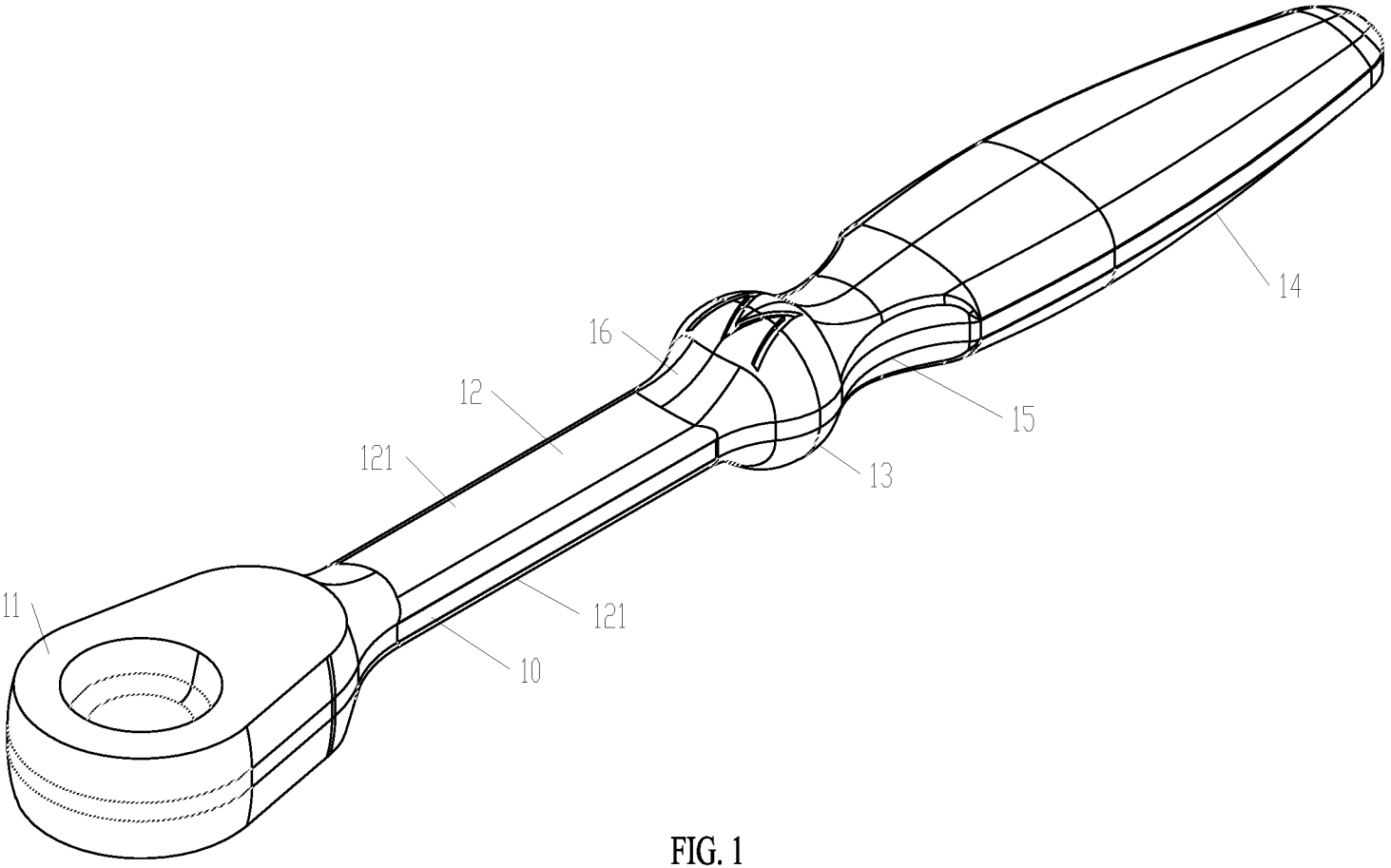
FIG. 1 is a perspective view of a wrench structure in accordance with the preferred embodiment of the present invention.
Figure 2:
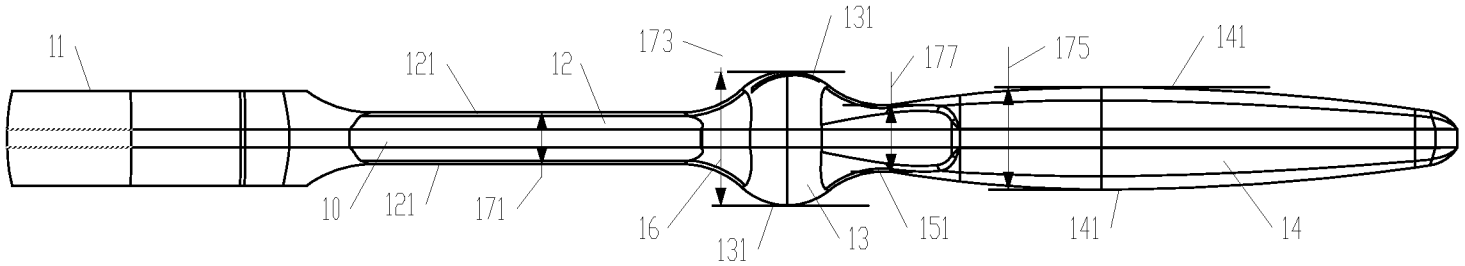
FIG. 2 is a side view of the wrench structure in accordance with the preferred embodiment of the present invention.
Figure 3:
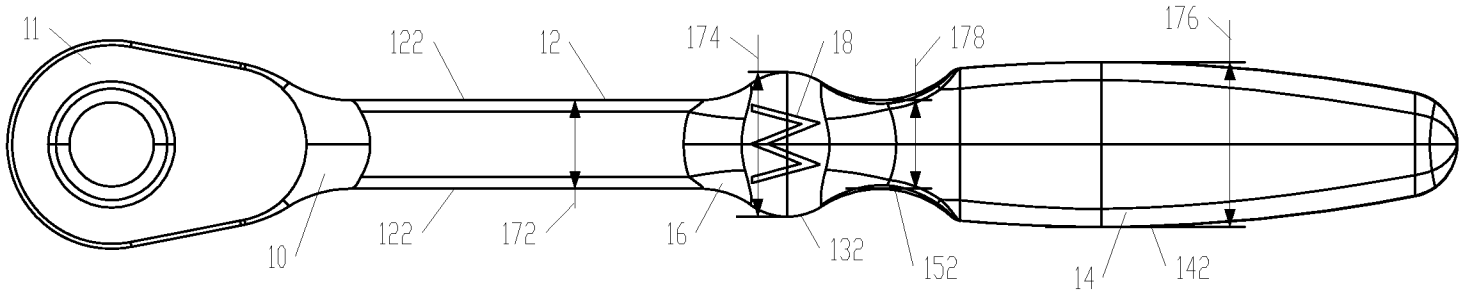
FIG. 3 is a top view of the wrench structure in accordance with the preferred embodiment of the present invention.

Referring to the drawings and initially to FIGS. 1-3, a wrench structure in accordance with the preferred embodiment of the present invention comprises a main body 10. The main body 10 is provided with a drive portion 11, a shank 12, a protruding block 13, and a handle 14.

The drive portion 11 may be assembled with a reversible ratchet mechanism. The shank 12 is connected with the drive portion 11. The shank 12 has cuboid shape. The shank 12 has two first faces 121 formed on a top and a bottom thereof. The two first faces 121 are parallel with each other. Each of the two first faces 121 has a planar shape. The shank 12 has two second faces 122 (see FIG. 3) formed on two sides thereof. The two second faces 122 are parallel with each other. Each of the two second faces 122 has a planar shape. The two second faces 122 are perpendicular to the two first faces 121.

The protruding block 13 has a spherical or polygonal shape. The shank 12 is arranged between the drive portion 11 and the protruding block 13. The protruding block 13 has two third faces 131 formed on a top and a bottom thereof. Each of the two third faces 131 has an arcuate shape and includes a plurality of curved surfaces. The protruding block 13 has two fourth faces 132 formed on two sides thereof. Each of the two fourth faces 132 has an arcuate shape and includes a plurality of curved surfaces.

The handle 14 is distant from the drive portion 11. The handle 14 has two fifth faces 141 formed on a top and a bottom thereof. Each of the two fifth faces 141 has an arcuate shape and includes a plurality of curved surfaces.

The handle 14 has two sixth faces 142 formed on two sides thereof. Each of the two sixth faces 142 has an arcuate shape and includes a plurality of curved surfaces.

The main body 10 is further provided with a first connecting portion 15 arranged between and connected with the protruding block 13 and the handle 14. The first connecting portion 15 has two seventh faces 151 formed on a top and a bottom thereof. Each of the two seventh faces 151 has a concave arcuate shape and includes a plurality of curved surfaces. Each of the two seventh faces 151 is tangent to one of the two third faces 131 and tangent to one of the two fifth faces 141. The first connecting portion 15 has two eighth faces 152 formed on two sides thereof. Each of the two eighth faces 152 has a concave arcuate shape and includes a plurality of curved surfaces. Each of the two eighth faces 152 is tangent to one of the two fourth faces 132 and not tangent to one of the two sixth faces 142.

The main body 10 is further provided with a second connecting portion 16 arranged between and connected with the shank 12 and the protruding block 13. The second connecting portion 16 is tangent to the two first faces 121 and tangent to the two second faces 122. The second connecting portion 16 is tangent to the two third faces 131 and tangent to the two fourth faces 132.

Thus, the main body 10 is sequentially provided with the drive portion 11, the shank 12, the second connecting portion 16, the protruding block 13, the first connecting portion 15, and the handle 14. Preferably, the drive portion 11, the shank 12, the second connecting portion 16, the protruding block 13, the first connecting portion 15, and the handle 14 are formed integrally. The shank 12, the protruding block 13, the first connecting portion 15, and the handle 14 have different height and width defined therebetween.

A first distance 171 defined between the two first faces 121 is a thickness of the shank 12. A second distance 172 defined between the two second faces 122 is a width of the shank 12. A third distance 173 is a maximum distance defined between the two third faces 131. A fourth distance 174 is a maximum distance defined between the two fourth faces 132. A fifth distance 175 is a maximum distance defined between the two fifth faces 141. A sixth distance 176 is a maximum distance defined between the two sixth faces 142. A seventh distance 177 is a minimum distance defined between the two seventh faces 151. An eighth distance 178 is a minimum distance defined between the two eighth faces 152.

The handle 14 has a middle position with a maximum thickness. The fifth distance 175 is arranged close to the middle position of the handle 14. The handle 14 has a distal position distant from the first connecting portion 15. The distal position of the handle 14 has a minimum thickness. The handle 14 has a proximate position close to the first connecting portion 15. The proximate position of the handle 14 has a larger width. The sixth distance 176 is arranged close to the first connecting portion 15. The distal position of the handle 14 has a smaller width.

The third distance 173 is more than the fifth distance 175. The fifth distance 175 is more than the seventh distance 177. The seventh distance 177 is more than the first distance 171.

The third distance 173 is two to three times more than the first distance 171. The third distance 173 is preferably 2.3 to 2.7 times more than the first distance 171. The third distance 173 is optimally 2.5 times more than the first distance 171.

The third distance 173 is 1.5 to 2.5 times more than the seventh distance 177. The third distance 173 is preferably 1.7 to 2.3 times more than the seventh distance 177. The third distance 173 is optimally two times more than the seventh distance 177.

The fifth distance 175 is 1.5 to 2.5 times more than the first distance 171. The fifth distance 175 is preferably two times more than the first distance 171.

The sixth distance 176 is more than the fourth distance 174. The fourth distance 174 is more than the second distance 172. The second distance 172 is more than the eighth distance 178. The fourth distance 174 is 1.3 to two times more than the second distance 172. The fourth distance 174 is optimally 1.6 times more than the second distance 172.

The protruding block 13 is provided with at least one indication member 18 (see FIG. 3). The at least one indication member 18 indicates the specification, mark, figure or type of the tool. The at least one indication member 18 includes a concave or convex texture.

Figure 4:
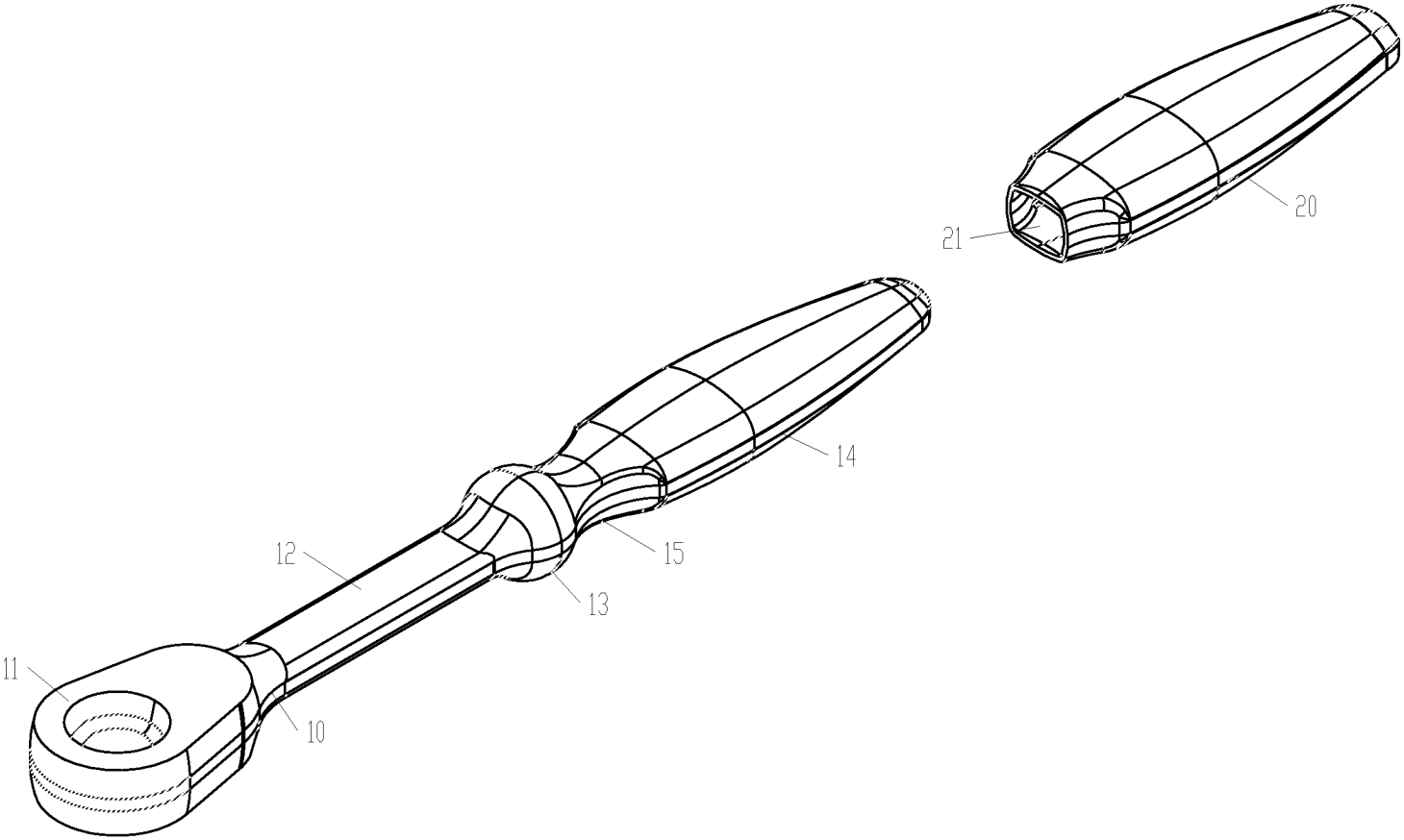
FIG. 4 is an exploded perspective view of a wrench structure in accordance with the second preferred embodiment of the present invention.
Figure 5:
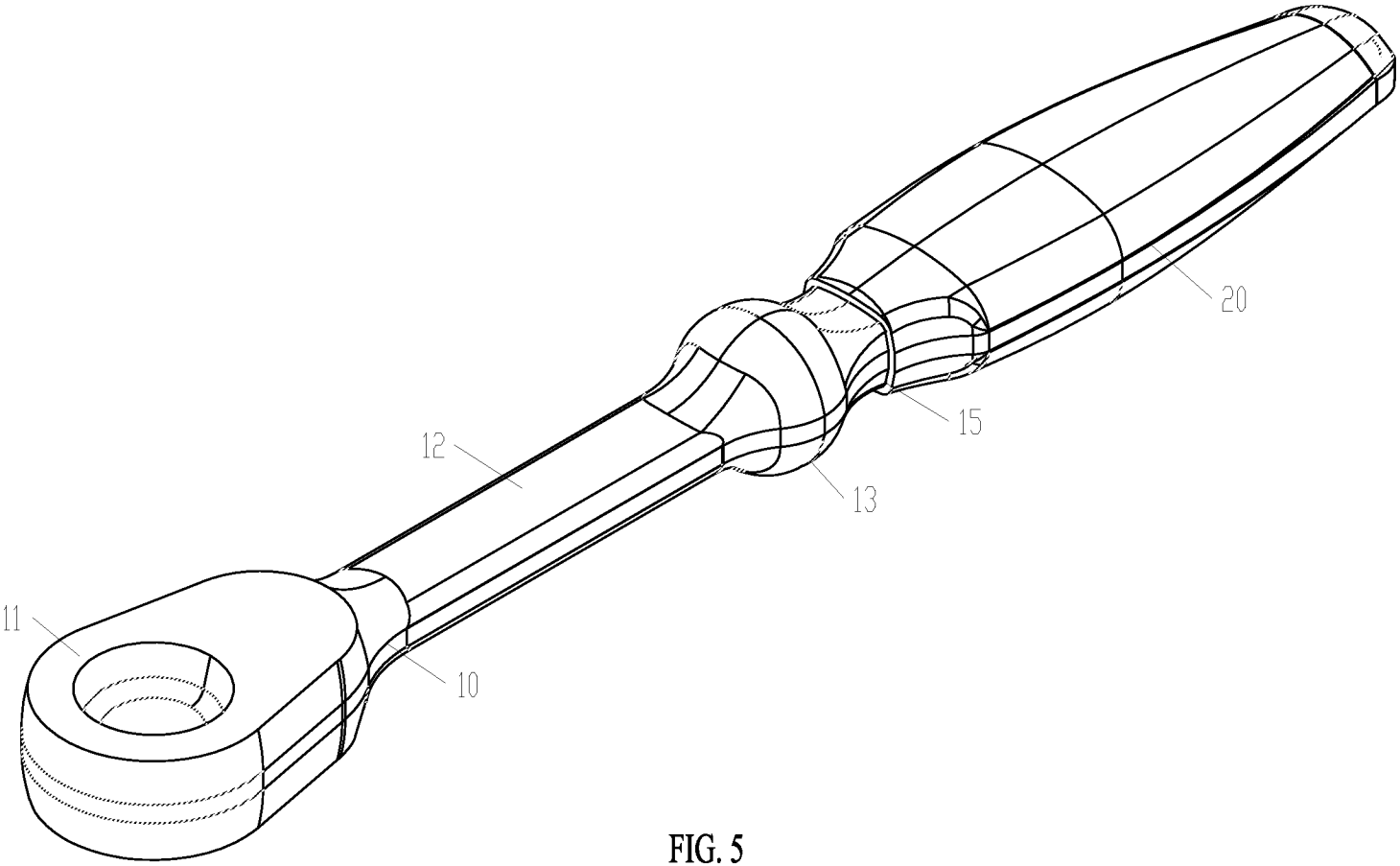
FIG. 5 is a perspective view of the wrench structure in accordance with the second preferred embodiment of the present invention.

Referring to FIGS. 4 and 5, the wrench structure further comprises a first mounting member 20 mounted on the main body 10. The first mounting member 20 is a thin shell made of resilient material, including plastics, rubber or the like. The first mounting member 20 is provided with a first mounting portion 21 mounted on the handle 14. The first mounting portion 21 has a shape corresponding to that of the handle 14. The first mounting portion 21 and the handle 14 are made of different material and have different colors. The first mounting portion 21 is provided with a texture or grain to facilitate the user holding and operating the first mounting portion 21.

Figure 6:
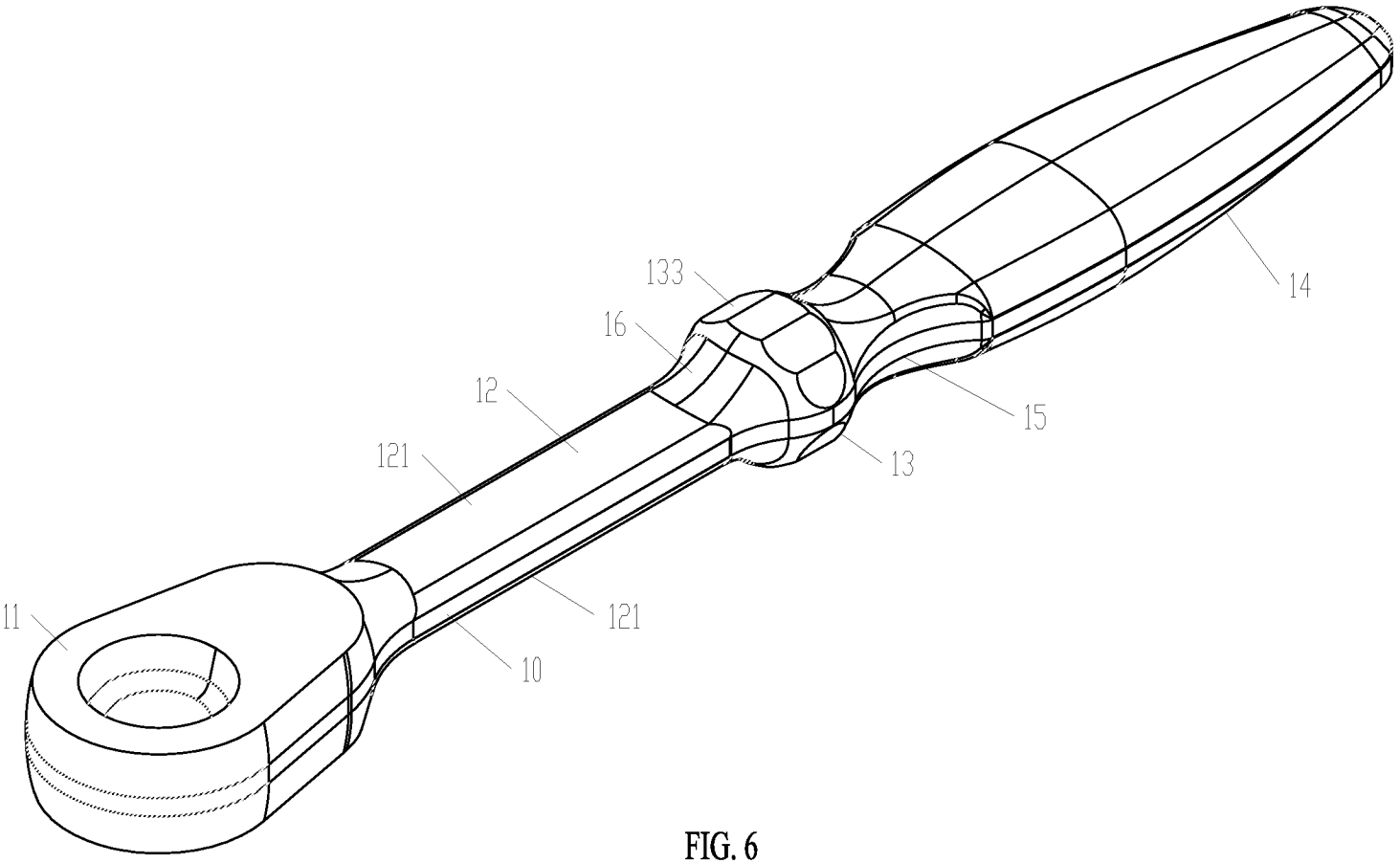
FIG. 6 is a perspective view of a wrench structure in accordance with the third preferred embodiment of the present invention.

Referring to FIG. 6, the protruding block 13 is provided with a plurality of planes 133 arranged in an annular shape. Each of the planes 133 has a flat shape.

Figure 7:
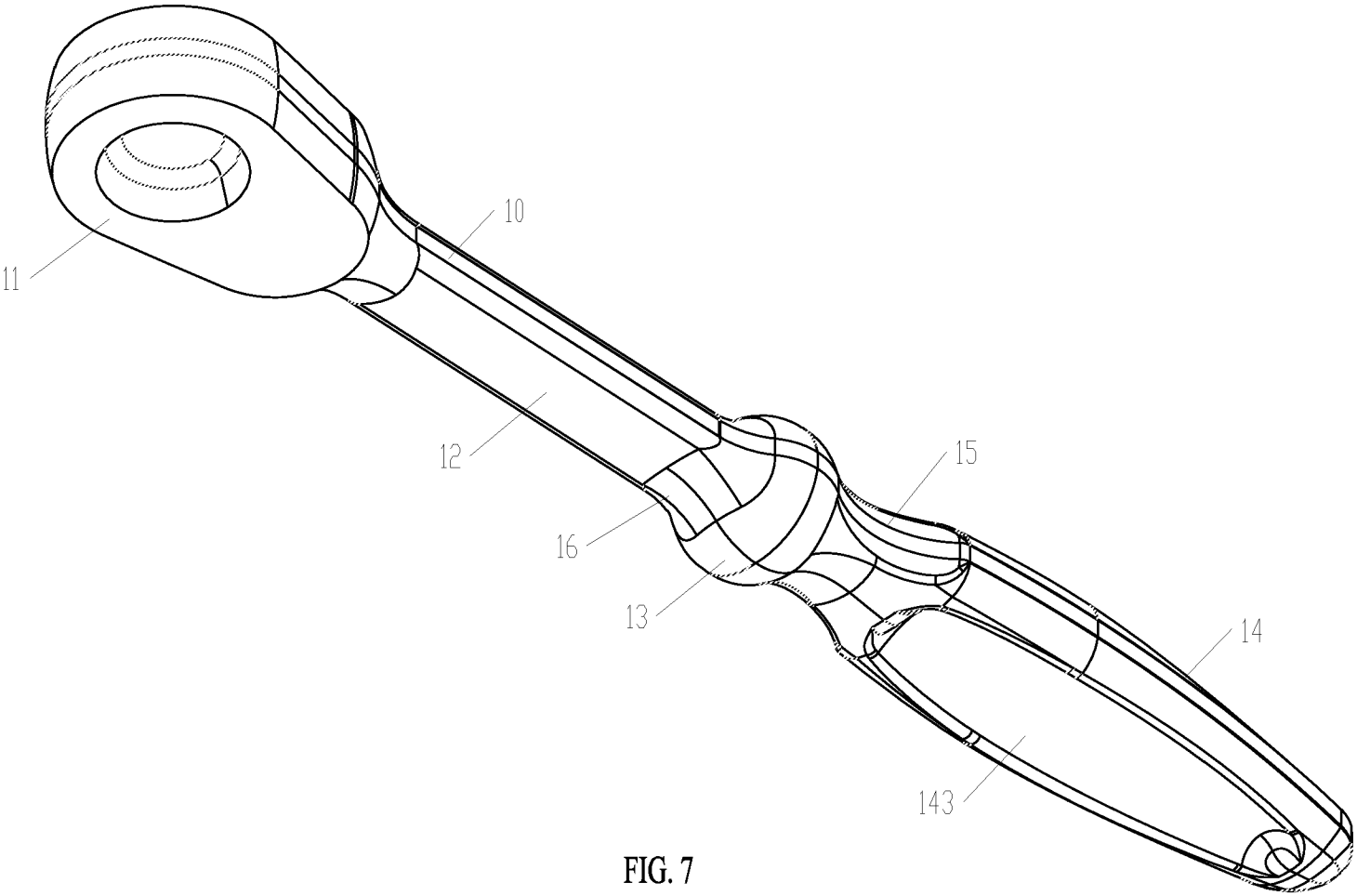
FIG. 7 is a perspective view of a wrench structure in accordance with the fourth preferred embodiment of the present invention.

Referring to FIG. 7, the handle 14 is provided with a recessed portion 143. The recessed portion 143 is an arcuate slot.

Figure 8:
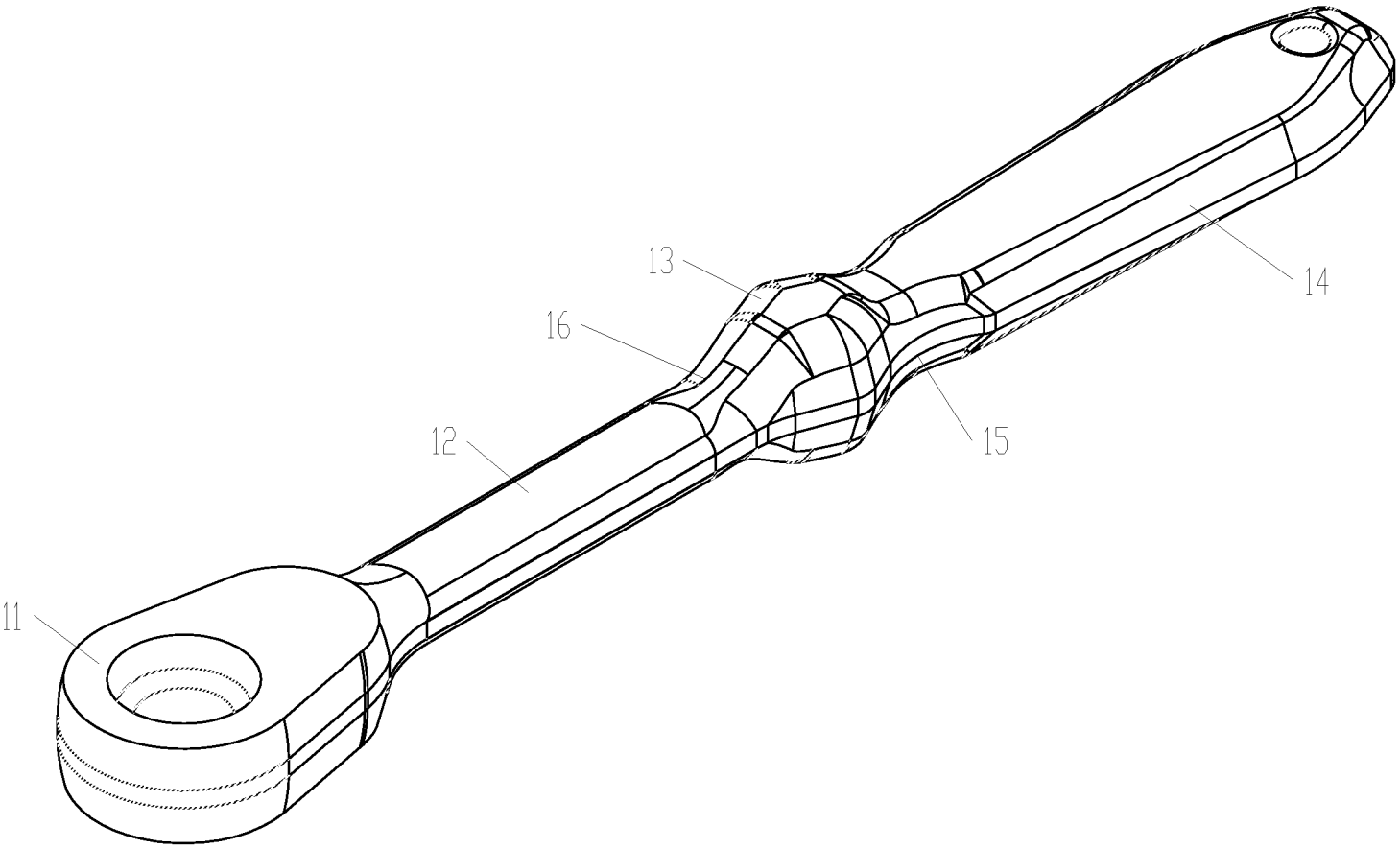
FIG. 8 is a perspective view of a wrench structure in accordance with the fifth preferred embodiment of the present invention.
Figure 9:
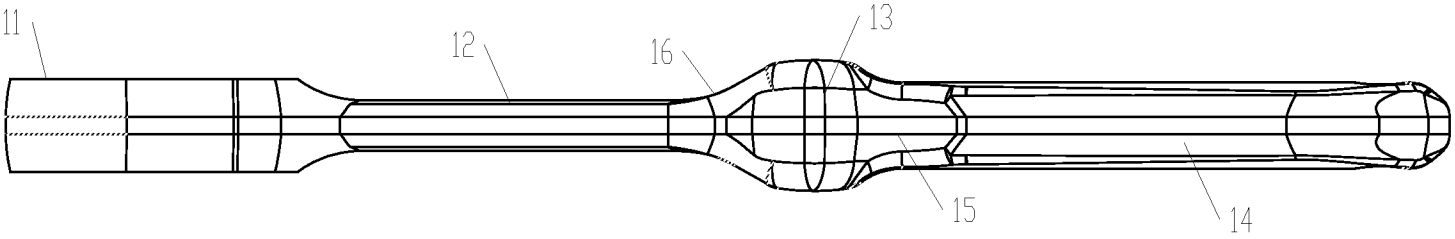
FIG. 9 is a side view of the wrench structure wrench structure as shown in FIG. 8.
Figure 10:
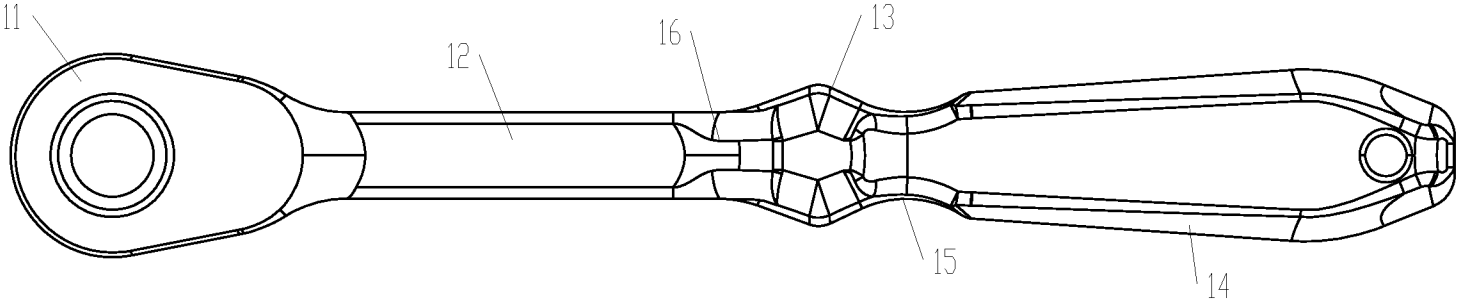
FIG. 10 is a side view of the wrench structure wrench structure as shown in FIG. 8.

Referring to FIGS. 8-10, the protruding block 13 has a polygonal diamond (or rhombus) shape. The handle 14 is provided with a hanging hole to facilitate the user hanging and storing the wrench structure. The hanging hole penetrates the handle 14.

Figure 11:
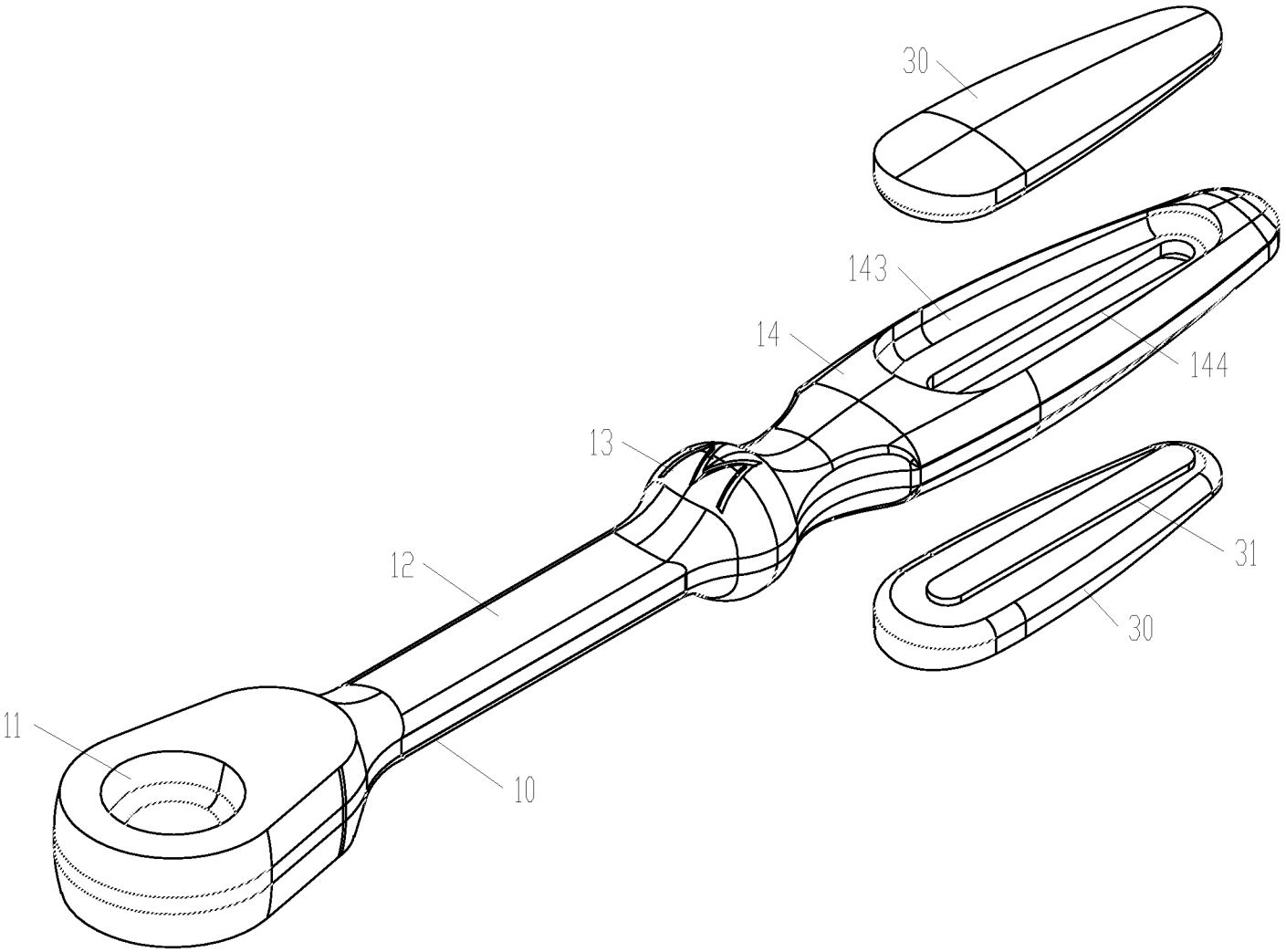
FIG. 11 is an exploded perspective view of a wrench structure in accordance with the sixth preferred embodiment of the present invention.
Figure 12:
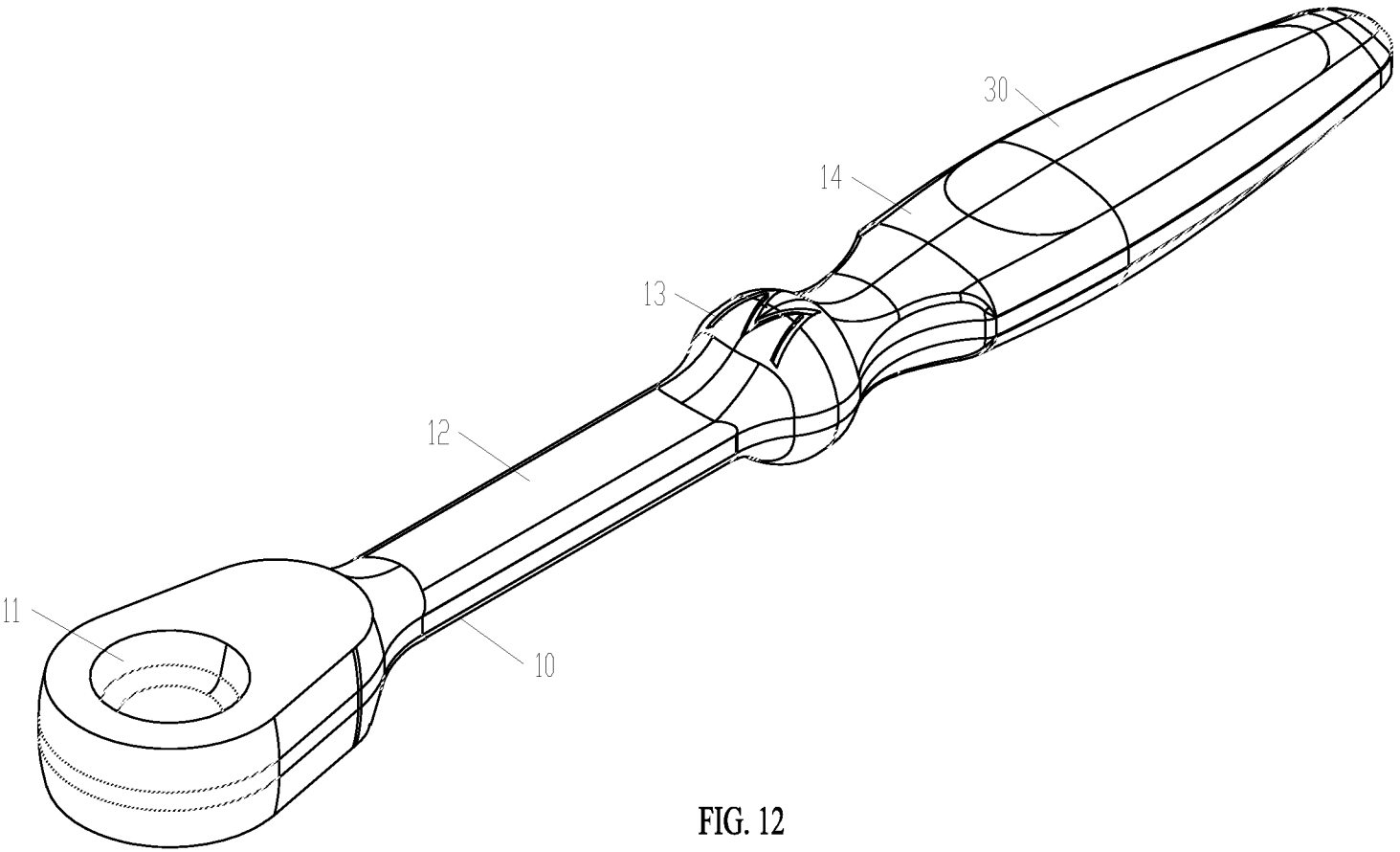
FIG. 12 is a perspective view of the wrench structure in accordance with the sixth preferred embodiment of the present invention.

Referring to FIGS. 11 and 12, the handle 14 is provided with two recessed portions 143 and a passage 144. The two recessed portions 143 are arranged symmetrically relative to the handle 14. The passage 144 is arranged between the two recessed portions 143 and has an elongate shape. The wrench structure further comprises two second mounting members 30 mounted in the two recessed portions 143. The two second mounting members 30 are bonded onto the two recessed portions 143 by adhesive. Each of the two second mounting members 30 has a shape corresponding to that of each of the two recessed portions 143. Each of the two second mounting members 30 is provided with a second mounting portion 31 mounted in the passage 144. The second mounting portions 31 of the two second mounting members 30 contact with each other in the passage 144 and are combined by adhesive.

Accordingly, the wrench structure has the following advantages.

1. The shank 12, the protruding block 13, the first connecting portion 15, and the handle 14 have different height and width defined therebetween. The protruding block 13 has the maximum height and width. Thus, when the main body 10 is placed on a plane, the protruding block 13 and the handle 14 rest on the plane, while a gap is defined between the shank 12 and the plane and defined between the first connecting portion 15 and the plane, so that the use takes the wrench structure easily through the shank 12 and the first connecting portion 15.

2. When the user holds the handle 14, the user's finger may rest on the first connecting portion 15 according to the requirement. Each of the two seventh faces 151 has a concave arcuate shape, and each of the two eighth faces 152 has a concave arcuate shape, to facilitate the user rotating the wrench structure.

3. When the user holds the main body 10, the user's finger may rest on the protruding block 13 to operate the wrench structure exactly.

4. When the user takes the wrench structure, the user's palm directly holds the protruding block 13 to operate the wrench structure conveniently.

5. The main body 10 has different height and width by provision of the shank 12, the protruding block 13, the first connecting portion 15, and the handle 14 so that the main body 10 provides a three-dimensional sensation.

6. The main body 10 is provided with the at least one indication member 18 to indicate the specification, mark, figure, size or type of the wrench structure.

7. The first mounting member 20 provides a comfortable sensation to the user when the user holds the handle 14. Besides, the first mounting member 20 has a nonslip effect.

8. The user's finger extends into the recessed portion 143 so that the user holds the handle 14 to operate the main body 10 steadily. Besides, the recessed portion 143 reduces the whole weight of the wrench structure.

9. The protruding block 13 is provided with a plurality of planes 133 so that when the main body 10 is placed on a plane, the wrench structure will not roll easily. Besides, the planes 133 prevent the user's hand from slipping when operating the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A wrench structure comprising:

a main body provided with a drive portion, a shank, a protruding block, and a handle;

wherein:

the shank is connected with the drive portion;

the shank has two first faces formed on a top and a bottom thereof;

the two first faces are parallel with each other;

each of the two first faces has a planar shape;

the shank has two second faces formed on two sides thereof;

the two second faces are parallel with each other;

each of the two second faces has a planar shape;

the two second faces are perpendicular to the two first faces;

the shank is arranged between the drive portion and the protruding block;

the protruding block has two third faces formed on a top and a bottom thereof;

each of the two third faces has an arcuate shape and includes a plurality of curved surfaces;

the protruding block has two fourth faces formed on two sides thereof;

each of the two fourth faces has an arcuate shape and includes a plurality of curved surfaces;

the handle has two fifth faces formed on a top and a bottom thereof;

each of the two fifth faces has an arcuate shape and includes a plurality of curved surfaces;

the handle has two sixth faces formed on two sides thereof;

each of the two sixth faces has an arcuate shape and includes a plurality of curved surfaces;

the main body is further provided with a first connecting portion arranged between and connected with the protruding block and the handle;

the first connecting portion has two seventh faces formed on a top and a bottom thereof;

each of the two seventh faces has a concave arcuate shape and includes a plurality of curved surfaces;

each of the two seventh faces is tangent to one of the two third faces and tangent to one of the two fifth faces;

the first connecting portion has two eighth faces formed on two sides thereof;

each of the two eighth faces has a concave arcuate shape and includes a plurality of curved surfaces;

each of the two eighth faces is tangent to one of the two fourth faces;

the main body is further provided with a second connecting portion arranged between and connected with the shank and the protruding block;

the second connecting portion is tangent to the two first faces and tangent to the two second faces;

the second connecting portion is tangent to the two third faces and tangent to the two fourth faces;

the main body is sequentially provided with the drive portion, the shank, the second connecting portion, the protruding block, the first connecting portion, and the handle;

the drive portion, the shank, the second connecting portion, the protruding block, the first connecting portion, and the handle are formed integrally;

the shank, the protruding block, the first connecting portion, and the handle have different height and width defined therebetween;

a first distance defined between the two first faces is a thickness of the shank;

a second distance defined between the two second faces is a width of the shank;

a third distance is a maximum distance defined between the two third faces;

a fourth distance is a maximum distance defined between the two fourth faces;

a fifth distance is a maximum distance defined between the two fifth faces;

a sixth distance is a maximum distance defined between the two sixth faces;

a seventh distance is a minimum distance defined between the two seventh faces;

an eighth distance is a minimum distance defined between the two eighth faces;

the handle has a middle position with a maximum thickness;

the fifth distance is arranged close to the middle position of the handle;

the handle has a distal position distant from the first connecting portion;

the distal position of the handle has a minimum thickness;

the handle has a proximate position close to the first connecting portion;

the sixth distance is arranged close to the first connecting portion;

the third distance is more than the fifth distance;
the fifth distance is more than the seventh distance;
the seventh distance is more than the first distance;
the sixth distance is more than the fourth distance;
the fourth distance is more than the second distance; and
the second distance is more than the eighth distance.

2. The wrench structure as claimed in claim 1, wherein the drive portion may be assembled with a reversible ratchet mechanism.

3. The wrench structure as claimed in claim 1, wherein the third distance is two to three times more than the first distance, the third distance is 2.3 to 2.7 times more than the first distance, and the third distance is optimally 2.5 times more than the first distance.

4. The wrench structure as claimed in claim 1, wherein the third distance is 1.5 to 2.5 times more than the seventh distance, the third distance is 1.7 to 2.3 times more than the seventh distance, and the third distance is optimally two times more than the seventh distance.

5. The wrench structure as claimed in claim 1, wherein the fifth distance is 1.5 to 2.5 times more than the first distance, and the fifth distance is two times more than the first distance.

6. The wrench structure as claimed in claim 1, wherein the fourth distance is 1.3 to two times more than the second distance, and the fourth distance is optimally 1.6 times more than the second distance.

7. The wrench structure as claimed in claim 1, wherein the protruding block is provided with at least one indication member, and the at least one indication member includes a texture.

8. The wrench structure as claimed in claim 1, further comprising:
a first mounting member mounted on the main body;
wherein:
the first mounting member is a thin shell made of resilient material;
the first mounting member is provided with a first mounting portion mounted on the handle;
the first mounting portion has a shape corresponding to that of the handle;
the first mounting portion and the handle are made of different material and have different colors; and
the first mounting portion is provided with a texture.

9. The wrench structure as claimed in claim 1, wherein the protruding block is provided with a plurality of planes arranged in an annular shape, and each of the planes has a flat shape.

10. The wrench structure as claimed in claim 1, wherein the handle is provided with a recessed portion, and the recessed portion is an arcuate slot.

11. The wrench structure as claimed in claim 1, wherein the protruding block has a polygonal diamond shape, the handle is provided with a hanging hole, and the hanging hole penetrates the handle.

12. The wrench structure as claimed in claim 1, wherein:
the handle is provided with two recessed portions and a passage;
the two recessed portions are arranged symmetrically relative to the handle;
the passage is arranged between the two recessed portions and has an elongate shape;
the wrench structure further comprises two second mounting members mounted in the two recessed portions;
the two second mounting members are bonded onto the two recessed portions;
each of the two second mounting members has a shape corresponding to that of each of the two recessed portions;
each of the two second mounting members is provided with a second mounting portion mounted in the passage; and
the second mounting portions of the two second mounting members contact with each other in the passage and are combined.

* * * * *